United States Patent [19]

Rezanka

[11] Patent Number: 5,036,337

[45] Date of Patent: Jul. 30, 1991

[54] THERMAL INK JET PRINTHEAD WITH DROPLET VOLUME CONTROL

[75] Inventor: Ivan Rezanka, Pittsford, N.Y.

[73] Assignee: Xerox Corporation, Stamford, Conn.

[21] Appl. No.: 542,490

[22] Filed: Jun. 22, 1990

[51] Int. Cl.[5] ..... B41J 2/05

[52] U.S. Cl. ..... 346/1.1; 346/140 R

[58] Field of Search ..... 346/1.1, 140, 76 PH

[56] References Cited

U.S. PATENT DOCUMENTS

| | | | |
|---|---|---|---|
| Re. 32,572 | 1/1988 | Hawkins et al. | 156/626 |
| 4,345,262 | 8/1982 | Shirato et al. | 346/140 R |
| 4,503,444 | 3/1985 | Tacklind | 346/140 X |
| 4,571,599 | 2/1986 | Rezanka | 346/140 R |
| 4,633,269 | 12/1986 | Mikami et al. | 346/76 PH |
| 4,675,695 | 6/1987 | Samuel | 346/1.1 |
| 4,688,051 | 8/1987 | Kawakami et al. | 346/76 PH |
| 4,745,413 | 5/1988 | Brownstein et al. | 346/76 PH |
| 4,774,530 | 9/1988 | Hawkins | 346/140 R |
| 4,831,390 | 5/1989 | Deshpande et al. | 346/140 R |
| 4,872,028 | 10/1989 | Lloyd | 346/1.1 |
| 4,908,635 | 3/1990 | Iwasawa | 346/140 |

*Primary Examiner*—Joseph W. Hartary

*Attorney, Agent, or Firm*—Robert A. Chittum

[57] ABSTRACT

A method and apparatus for controlling the volume of ink droplets ejected from thermal ink jet printheads is disclosed. The electrical signals applied to heating elements for generating droplet ejecting bubbles thereon are composed of packets of electrical pulses. Each pulse and spacing therebetween are varied in accordance with one or more whole, clock or timing units. The number of pulses per packet and width of pulses and spacing therebetween are controlled in accordance with the manufacturing tolerance variations, the location of the addressed heating element in the printhead, the number of parallel heating elements concurrently energized, and optionally the temperature of the printhead in the vicinity of the heating elements to maintain the desired volume of the ejected droplets.

6 Claims, 8 Drawing Sheets

THERMAL INK JET PRINTHEAD WITH DROPLET VOLUME CONTROL

BACKGROUND OF THE INVENTION

1. Field of the Invention

This invention relates to thermal ink jet printing devices and, more particularly, to thermal ink jet printheads having droplet generating heating elements which are energized by packets of constant amplitude pulses in which each pulse in the packet has its pulse length and intervening time intervals varied in response to the manufacturing tolerance variation, number of parallel heating elements concurrently energized, and the printhead temperature in the vicinity of the heating elements.

2. Description of the Prior Art

Thermal ink jet printing is generally a drop-on-demand type of ink jet printing system which uses thermal energy to produce a vapor bubble in an ink filled channel that expels a droplet. A thermal energy generator or heating element, usually a resistor, is located in the channels near the nozzle a predetermined distance therefrom. The resistors are individually addressed with an electric pulse to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and the bubble starts to move toward the collapsing bubble, causing a volumetric contraction of the ink at the nozzle and resuslting in separation of the bulging ink as a droplet. The acceleration of the ink out of the nozzle while the bubble is growing provides the momentum and velocity of the droplet in a substantially straight line towards a recording medium, such as paper.

Thus, thermal ink jet devices operate by pulsing heating elements in contact with ink so that bubbles are nucleated, ejecting ink droplets toward the paper. It has been found during print tests that print quality is affected as the device heats up. This is because the volume of the droplet and therefore the printed spot or pixel increases as a function of printhead temperature. Through study of this phenomenon, it has been found that both the mass and velocity of the droplet increase with device temperature, and that both the mass and velocity contribute to increase pixel size on the paper. For the carriage-type ink jet printer with sufficiently high printing density, the spot size increases as the carriage traverses the page. Then, as it pauses at the end of travel and reverses direction, it cools slightly, so that the next line or swath printed on the way back has increasing pixel sizes in the opposite direction. This gives rise to light and dark bands, which are most pronounced at the edges of the paper. Similarly, other patterns of high and low density printing are degraded by the increase in pixel size with device temperature.

Many of the prior art devices incorporate a heat sink of sufficient thermal mass and of low enough thermal resistance that the device temperature does not rise excessively. For one example of a thermal ink jet printhead having a heat sink, refer to U.S. Pat. No. 4,831,390 to Deshpande et al. This approach has eliminated the catastrophic printing failure mode. However, to lower the thermal resistance to the heat sink sufficiently that there is no appreciable device temperature rise in the time scale of a carriage translation in one direction across the paper, it may be necessary to take packaging approaches which would increase the cost or otherwise constrain the printer design in an undesirable way. The temperature rise must be maintained such that negligible image degradation occurs because of thermally induced spot size non-uniformities. The same printhead, but at an increased temperature, ejects a larger droplet which produces an increased spot size when printed on a recording medium, such as paper. This increased spot size may lead to observable print quality defects. Another factor which influences the energy required to vaporize the ink having the desired bubble volume is the manufacturing tolerance variation encountered for the heating elements. This is especially true for doped polysilicon heating elements.

A copending patent application Ser. No. 07/375,162, filed Jul. 3, 1989, entitled "Thermal Ink Jet Printhead With Constant Operating Temperature" to Kneezel et al, discloses means to prevent printhead temperature fluctuations during printing, especially in translatable carriage printers, by selectively energizing the heating elements not being used to eject droplets with energy pulses having insufficient magnitude to vaporize the ink. Patent application U.S. Ser. No. 07/457,499, filed Dec. 27, 1989, entitled "Method and Apparatus for Varying Pulse Duration and Power in a Thermal Ink Jet Printer to Maintain Constant Ink Droplet Size or Vary Ink Droplet Size", to Ims et al, discloses a method and apparatus for sensing the temperature of the printhead and varying the pulse parameters of the electrical signals applied to the heating element to maintain a substantially constant droplet size or to vary the size of the ink droplet. The variation of the pulse parameters includes variation of the pulse duration and voltage. These two copending applications are commonly assigned to the assignee of the present invention.

U.S. Pat. No. 4,872,028 to Lloyd discloses a thermal ink jet printing system having a drop detector which is used in a feedback loop to optimize operations drive pulse parameters of the electrical pulses supplied to the heating elements. During a maintenance procedure during startup, the test generator causes the pulse controller to test each of many drop generators with a series of fixed voltage rectangular pulses of digitally increasing pulse width. The pulse width at which a drop is first detected and the velocity of each drop detected is correlated with the width of the pulse which generated that drop. The algorithm function calculates an individual operational pulse width for each drop generator or alternatively, a common operational pulse width for all drop generators. The pulse parameter value set so determined is programmed into the pulse controller and used during normal printing operation. The advantages of pulse width as a variable notwithstanding, pulse amplitude is also a suitable variable pulse parameter. However, the control of the single pulse width and/or pulse amplitude is rather complex and expensive, and in the case of multiple printheads or individually controlled heating elements, the complexity and cost is prohibitively high.

Thermal printing, a related technology, is accomplished by raising the temperature of the thermal print medium above a threshold temperature whereupon a coating on the thermal print medium undergoes a chemical change and changes color. Typically, the temprature of a thermal print medium is raised by the use of a thermal printhead that includes one or more resistive print elements that are mounted, for example, on a ceramic substrate and that are maintained in contact with the thermal print medium. The configuration of each print element defines a portion of a character or an entire character to be printed. It is important that a thermal printer be capable of precisely controlling the amount and duration of heat to print each character portion. Control of the amount of heat applied to the thermal print medium is achieved in part by controlling the exposure time; that is, the time during which the thermal print medium is held above the conversion or printing temperature. In order to provide halftone or gray scale recording by a thermal printer, the temperature of the heating elements must be accurately controlled above a printing threshold temperature for various predetermined periods of time.

In contrast, ink jet printers must heat the heating elements to a temperature in which the liquid ink in contact therewith instantaneously vaporizes into a bubble and the duration in which the vaporization temperature is held by the heating element is minimized to the extent possible, so that the electrical pulse is immediately shutoff. U.S. Pat. No. 4,675,695 to Samuel discloses a technique whereby the electrical pulse applied to the heating element is shaped to reduce the maximum temperature of the heating elements. This is especially effective in thermal printing because the heating element must be maintained above a threshold temperature for a predetermined amount of time. The thermal printing apparatus of Samuel comprises a thermal print element and control means for providing energy at a first average rate for a time sufficient to raise the temperature to the print element from ambient temperature to a temperature above the threshold temperature and then provide an energy at a second average rate that is less than the first average rate, but nevertheless sufficient to maintain the temperature of the print element above the threshold temperature. The control means provides electrical energy to the thermal print element in response to a strobe signal which comprises a first pulse followed by a series of second pulses. The first pulse has a length sufficient to raise the temperature of the print element above the threshold temperature and the second pulse has a length shorter than the first and a series of second pulses has a duty cycle selected to maintain the temperature of the print element above the threshold temperature for a predetermined time period.

U.S. Pat. No. 4,633,269 to Mikami et al discloses a thermal printer which conducts recording by heating heat generating elements with a drive signal. The temperature of the heat generating elements after a specified period from the start of a thermals recording signal can be returned to a constant value, by applying during the normal cooling process, that is, after application of a thermal recording signal, a predetermined auxiliary pulse corresponding to the temperture that is generated during the thermal recording and to the tone to be recorded. Thus, a predetermined temperature is maintained from which the thermal print elements are pulsed thereby eliminating the affect of temperature differences resulting from stored energy which varies with the tone density required of the heating element in its previous energization.

U.S. Pat. No. 4,745,413 to Brownstein et al discloses a continuous tone thermal printer having a printhead with a plurality of hating elements. Each heating element is energized during first and second halves of a line print time interval to more uniformly distribute heat during such an interval. A storing means stores values representing a desired density of each image pixel of a line, while a means responsive to such stored numbers energizes each heating element during different portions of a time interval to cause heat produced by such heating elements to be uniformly distributed throughout the time interval to reduce line gaps.

U.S. Pat. No. 4,688,051 to Kawakami et al discloses a thermal printhead driving system which supplies a predetermined number of driving pulses to each of a plurality of heat producing elements. The pulse width of the driving pulse is controlled in accordance with the temperature in the vicinity of heat producing elements.

U.S. Pat. No. 4,345,262 to Shirato et al discloses a thermal ink jet recording method where the addressing pulse applied to the bubble generating heating elements have a specific pulse width range and the addressing cycle is at least three times as large as the pulse width.

U.S. Pat. No. Re. 32,572 to Hawkins et al discloses a thermal ink jet printhead and method of fabrication. A plurality of printheads are concurrently fabricated by forming a plurality of sets of heating elements with their individual addressing electrodes on one substrate surface and etching corresponding sets of grooves which may serve as ink channels with a common reservoir in the surface of a silicon wafer. The wafer and substrate are aligned and bonded together so that each channel has a heating element. The individual printheads are obtained by milling away the unwanted silicon material in the etched wafer to expose the addressing electrode terminals on the substrate and then the bonded substrate and wafer are diced into a plurality of separate printheads

SUMMARY OF THE INVENTION

It is the object of the present invention to provide a method and apparatus for controlling the volume of ink droplets ejected from thermal ink jet printheads.

It is another object of the invention to control the ejected droplet volume by use of a look-up table to take into account manufacturing tolerance variations and the number and position of parallel heating elements that are concurrently energized with a power supply.

It is still another object of the invention to control the ejected droplet volume by sensing the printhead temperature and controlling the shape of the average power pulse of the electrical energy applied to the heating elements of the printhead.

In the present invention, a method and apparatus for controlling the volume of ink droplets ejected from thermal ink jet printheads is provided by energizing the heating elements with packets of pulses, each packet causing the ejection of one droplet. Means are provided for adjusting the number of pulses per packet, as well as each pulse width and width of idle time between pulses to control the temperature sensitive volume of the ejected ink droplet. The method and apparatus further comprises sensing the temperature of the printheads in the vicinity of heating element and applying electrical energy signals to the heating elements in the form of pulse packets, which are adjusted to compensate for sensed printhead temperature. The electrical signals applied to the heating elements for generating droplet ejecting bubbles thereon are composed of packets of electrical pulses. The electrical pulses may be constant voltage, constant power, constant current, or other types of electrical pulses. Each pulse width and spacing between the multiple electrical pulses in each packet are varied in accordance with one or more whole clock units. The number of pulses per packet and the width of pulses and spacing therebetween are controlled in accordance with the number of simultaneously energized heating elements and their relative location in the printhead. In one embodiment, the number of pulses per packet, the width of the pulses in the packet, and the spacing therebetween are further controlled by the temperature of the printhead to maintain required performance.

A more complete understanding of the present invention can be obtained by considering the followintg detailed description in conjunction with the accompanying drawings, wherein like parts have the same index numerals.

DESCRIPTION OF THE PREFERRED EMBODIMENT

Figure 1:
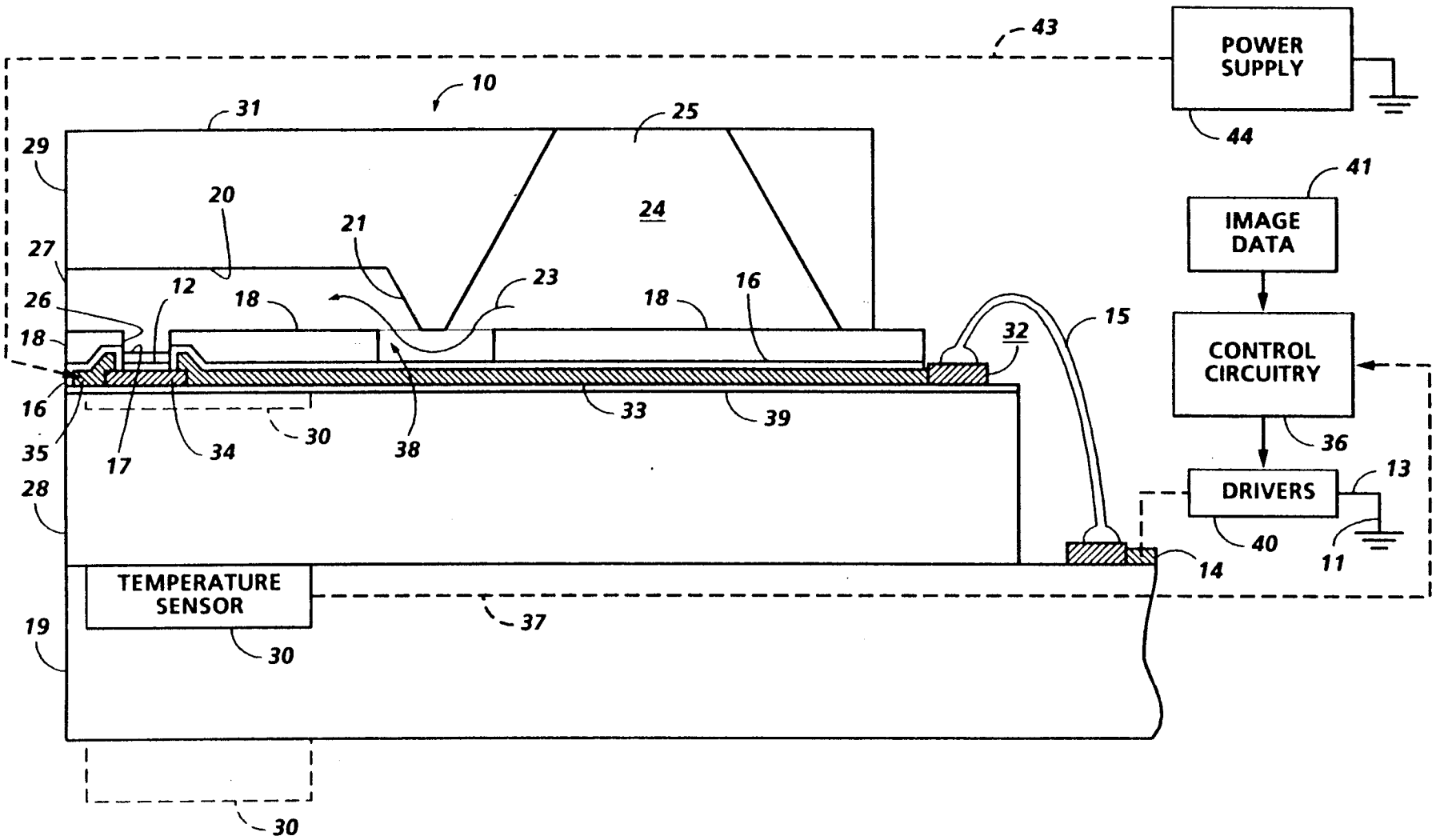
FIG. 1 is a cross-sectional schematic elevation view of the printhead having the control means of the present invention to control the volume of the ejected ink droplets.

A schematic cross-sectional, elevation view of a thermal ink jet printhead 10 of the type disclosed in U.S. Pat. No. 4,774,530 to Hawkins and incorporated herein by reference is shown in FIG. 1. The cross-sectional view is taken along one of the plurality of elongated ink flow channels 20. The printhead is composed of a silicon upper substrate or channel plate 31 aligned and bonded to an electrical insulating substrate or heating element plate 28, with an intermediate insulative thick film layer 18, patterned to expose the heating elements 34 and to provide a flow through passageway 38, sandwiched between the channel plate and heating element plate. Ink (not shown) flows from the manifold 24 and around the channel closed end 21 as depicted by arrow 23.

A plurality of sets of bubble generating heating elements 34 and their addressing electrodes 33 are patterned on the polished surface of a single side polished (100) silicon wafer (not shown). Prior to patterning the multiple sets of printhead electrodes 33, the resistive material 34 that serves as the heating elements, and the common return electrode 35, the polished surface of the wafer is coated with an underglaze layer 39 such as silicon dioxide, having a thickness of about 2 micrometers. The resistive material may be a doped polycrystalline silicon which may be deposited by chemical vapor deposition (CVD) or any other well known resistive material such as zirconium boride ($ZrB_2$). The common return and the addressing electrodes are typically aluminum leads deposited on the underglaze and over the edges of the heating elements. The common return and addressing electrode terminals 32 are positioned at predetermined locations to allow clearance for placement of wire bonds 15 to the electrodes 14 of the ceramic coated, metallic substrate or daughterboard 19, after the channel plate 31 is attached to make a printhead. The common return 35 and the addressing electrodes 33 are deposited to a thickness of 0.5 to 3 micrometers, with the preferred thickness being 1.5 micrometers.

In the preferred embodiment, heating element plate 28 is silicon with an underglaze layer 39 of thermal oxide or other suitable insulative layer such as silicon dioxide. Polysilicon heating elements 34 are formed and optionally another insulative overglaze layer (not shown) is deposited over the underglaze layer and heating elements thereon. This overglaze layer may be either silicon dioxide, silicon nitride, thermal oxide, or reflowed polysilicon glass (PSG). The thermal oxide layer is typically grown to a thickness of 0.2 micrometer or less to insulate the heating elements from the conductive ink. Reflowed PSG is usually about 0.5 micrometers thick. The overglaze layer is masked and etched to produce vias therein near the edges of the heating elements for subsequent electrical interface with the aluminum (Al) addressing electrode 33 and Al common return electrode 35. In addition, the overglaze layer in the bubble generating region of the heating element 34 is concurrently removed. If other resistive material such as hafnium boride or zirconium boride is used for the heating elements, then other suitable well known insulative materials may be used.

The next process step in fabricating the thermal transducer is to deposit a pyrolytic silicon nitride layer 17 directly on the exposed polysilicon heating elements, followed by the deposition of a one micrometer thick tantalum layer 12 for cavitational stress protection of the pyrolytic silicon nitride layer 17.

For electrode passivation, a two micrometer thick phosphorous doped CVD silicon dioxide film 16 is deposited over the entire heating element plate or wafer surface, including the plurality of set of heating elements and addressing electrodes. The passivation film 16 provides an ion barrier which will protect the exposed electrodes from the ink. Other ion barriers may be used, such as, for example, polyimide, plasma nitride, as well as the above-mentioned phosphorous doped silicon dioxide, or any combinations thereof. An effective ion barrier layer is achieved when its thickness is between 1000 angstroms and 10 micrometers, with the preferred thickness being 1 micrometer. The passivation film or layer 16 is etched off of the terminal ends of the common return and addressing electrodes for wire bonding later with the daughter board electrodes.

Next, a thick film type insulative layer 18 such as, for example, Riston®, Vacrel®, Probimer 52®, or polyimide, is formed on the passivation layer 16 having a thickness of between 10 and 100 micrometers and preferably in the range of 25 to 50 micrometers. The insulative layer 18 is photolithographically processed to enable etching and removal of those portions of the layer 18 over each heating element (forming pits or recesses 26), the elongated recess 38 for providing ink passage from the manifold 24 to the ink channels 20, and over each electrode terminal 32.

The pit 26 inhibits lateral movement of each bubble generated by the pulsed heating element, and thus promote bubble growth in a direction normal thereto. Therefore, as disclosed in U.S. Pat. No. 4,638,337, the blowout phenomena of releasing a burst of vaporized ink which causes an ingestion of air is avoided.

As disclosed in U.S. Pat. No. Re. 32,572, incorporated herein by reference, the channel plate if formed from a (100) silicon wafer (not shown) to produce a plurality of channel plates 31 for the printhead. The heating element plate 28 is also obtained from a wafer or wafer sized structure (not shown) containing a plurality thereof. Relatively large rectangular through recesses and a plurality of sets of equally, spaced parallel V-groove recesses are etched in one surface of the wafer. These recesses will eventually become the ink manifolds 24, the open bottom of which will serve as ink inlets 25, and ink channels 20 of the printheads. The wafers containing the plurality of channel plates and heating element plates are aligned and bonded together, then diced into a plurality of individual printheads. One of the dicing cuts produces end face 29, opens one end of the elongated V-groove recesses 20 producing nozzles 27. The other ends of the V-groove recesses 20 remain closed by end 21. However, the alignment and bonding of the above-mentioned wafers places the ends 21 of each set of channels 20 directly over elongated recess 38 in the thick film insulative layer 18, enabling the flow of ink into the channels from the manifold 24 as depicted by arrow 23.

The individual printheads may be mounted on daughterboards 19 having electrodes 14 which are wire bonded to the electrode terminals 32 of the printhead for use in a carriage type ink yet printer as disclosed in U.S. Pat. No. 4,571,599 to Rezanka, or a plurality of printheads may be placed on a pagewidth bar (not shown) to form a fixed pagewidth printhead. The principal of operation of the present invention is the same, so the invention will be explained with reference to a single channel and nozzle of a typical reciprocating, carriage type printhead shown in FIG. 1.

As is well known in the art, the operating sequence of the bubble jet systems starts with an electrical pulse through the resistive heating element in the ink filled channel. In order for the printer to function properly, heat transferred from the heating element to the ink must be of sufficient magnitude to super heat the ink contacting the heating element far above its normal boiling point. For water based inks, the temperature for substantially instantaneously vaporizing the ink is about 280° C. The expansion of the bubble forces a droplet of ink out of the nozzle. The heating element at this point is no longer being heated because the electrical pulse has passed and concurrently with the bubble collapse, the droplet is propelled at a high rate of speed in a direction towards a recording medium, such as paper. The entire bubble formation/collapse sequence occurs in about 30 μseconds. The channel can be refilled after 100–500 μseconds minimum dwell time to enable the channel to be refilled and to enable the dynamic refilling factors to become dampened.

As heat is added to the printhead during the printing operation, the volume and velocity of the ink droplet increases. Thus, for high printing, the temperature of the printhead and the magnitude of the thermal energy generated by the pulsed heating element must be taken into account and controlled to maintain constant ink droplet volume and droplet velocity.

Figure 2:
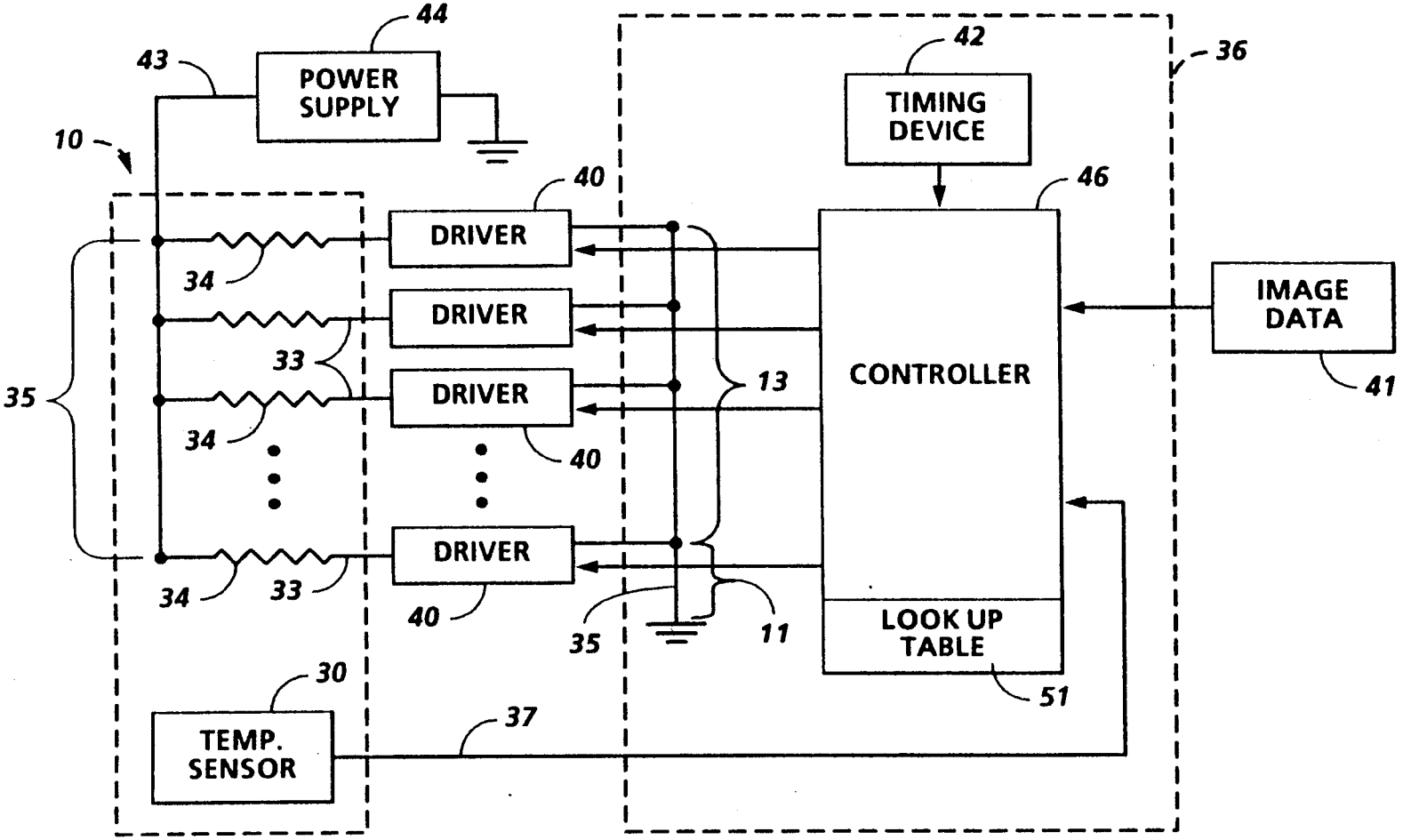
FIG. 2 is a block diagram of a circuit for energizing the heating elements of the printhead.

Referring to FIGS. 1 and 2, a temperature sensor 30, though not essential, provides enhanced droplet volume control capability and is attached to the surface of the heating element plate 28 opposite the surface having the heating elements and prior to mounting of the printhead on a ceramic coated, metallic substrate 19, containing electrodes 14 on the surface of the ceramic coating. The printhead may be, for example, bonded to the ceramic coated, metallic substrate with a suitable adhesive. The thickness of the temperature sensor is about 1 to 10 mils, so that it will not interfere with the attachment of the printhead to the metallic substrate or daughterboard. The temperature sensor may be optionally located on the same surface of the heating element plate 28 that contains the heating elements 34 or on the opposite side of the ceramic coated, metallic substrate as shown in dashed line. The temperature signal line 37 may be a dedicated electrode mounted on either side of the ceramic coated, metallic substrate 19. The temperature signals from the sensor 30 is directed to the controller 46 in control circuitry 36 via line 37. A timing device 42, such as a digital clock or analog timer, and digitized image input data signals 41 are directed to the controller. In response thereto, the controller enables the energization of selected heating elements through associated drivers 40, as discussed below. The heating elements 34 are connected to a power supply 44 via line 43 and common return electrode 35. The drivers are connected to the heating elements via addressing electrodes 33, wire bonds 15, and daughterboard electrodes 14; the drivers are connected to ground through return or sink lines 13 and cable 11.

Figure 3:
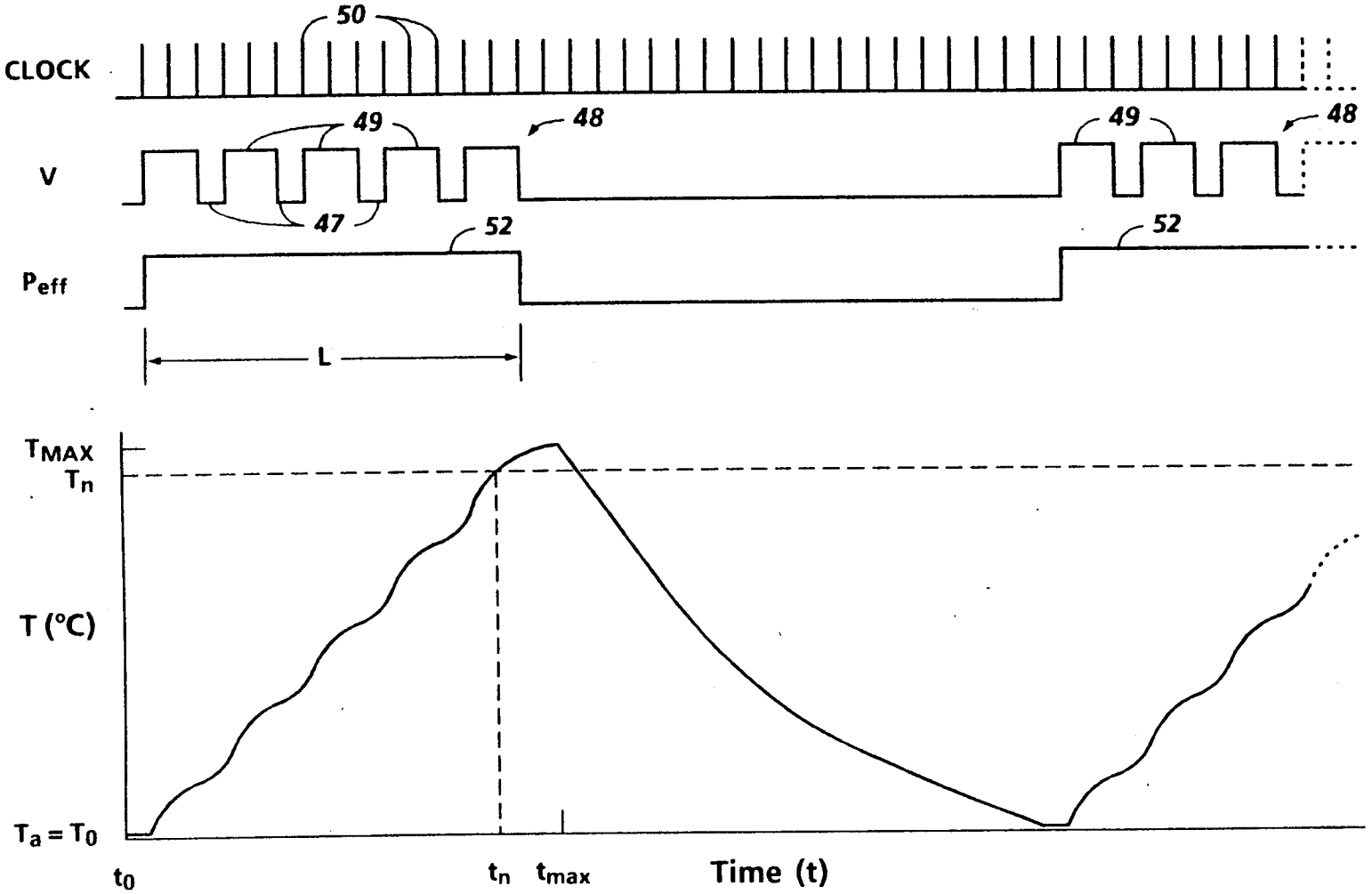
FIGS. 3-5 show the waveforms of the droplet generating pulse packets and effective power pulses generated thereby and temperature of the ink which contacts the heating element to illustrate the temperature characteristics of the heating element according to the present invention.

As shown in FIG. 3, the electrical signals which energize the heating elements are packets of electrical pulses 48. In the preferred embodiment, each pulse packet 48 consists of a number of individual, constant voltage pulses 49 that provides an effective power ($p_{eff}$) pulse 52 having a length substantially equal to the length (L) of the pulse packet. Each individual pulse 49 and idle time 47 between them each have widths equal to the distance/time between one or more clock or timing units 50. The pulse packet 48 is shown comprising five equal amplitude pulses 49, each having a pulse width equal to two clock units and separated by off times or idle times equal to one clock unit. Such a pulse packet generates an effective power pulse 52 having a substantially flat waveform. The temperature (T) of the ink contacting the heating element rises with each indivdual pulse 49 of the packet 48 and exceeds the nucleation temperature ($T_n$) of 280° C. during the last pulse in the packet at time ($t_n$) from the time ($t_o$) in which the pulse packet was initiated. The maximum temperature ($T_{max}$) is achieved shortly after the last pulse 49 of the packet 48 is switched off. In this example, the initial temperature ($T_o$) of the ink adjacent the heating element is equal to the ambient temperature ($T_a$), as is the case when the printhead is started after being in the non-printing mode for a while. This illustrative example is for explanation of the invention rather than a true representation of waveforms, since the number of pulses per packet is generally higher than the five pulses chosen for convenient illustration.

Figure 6:
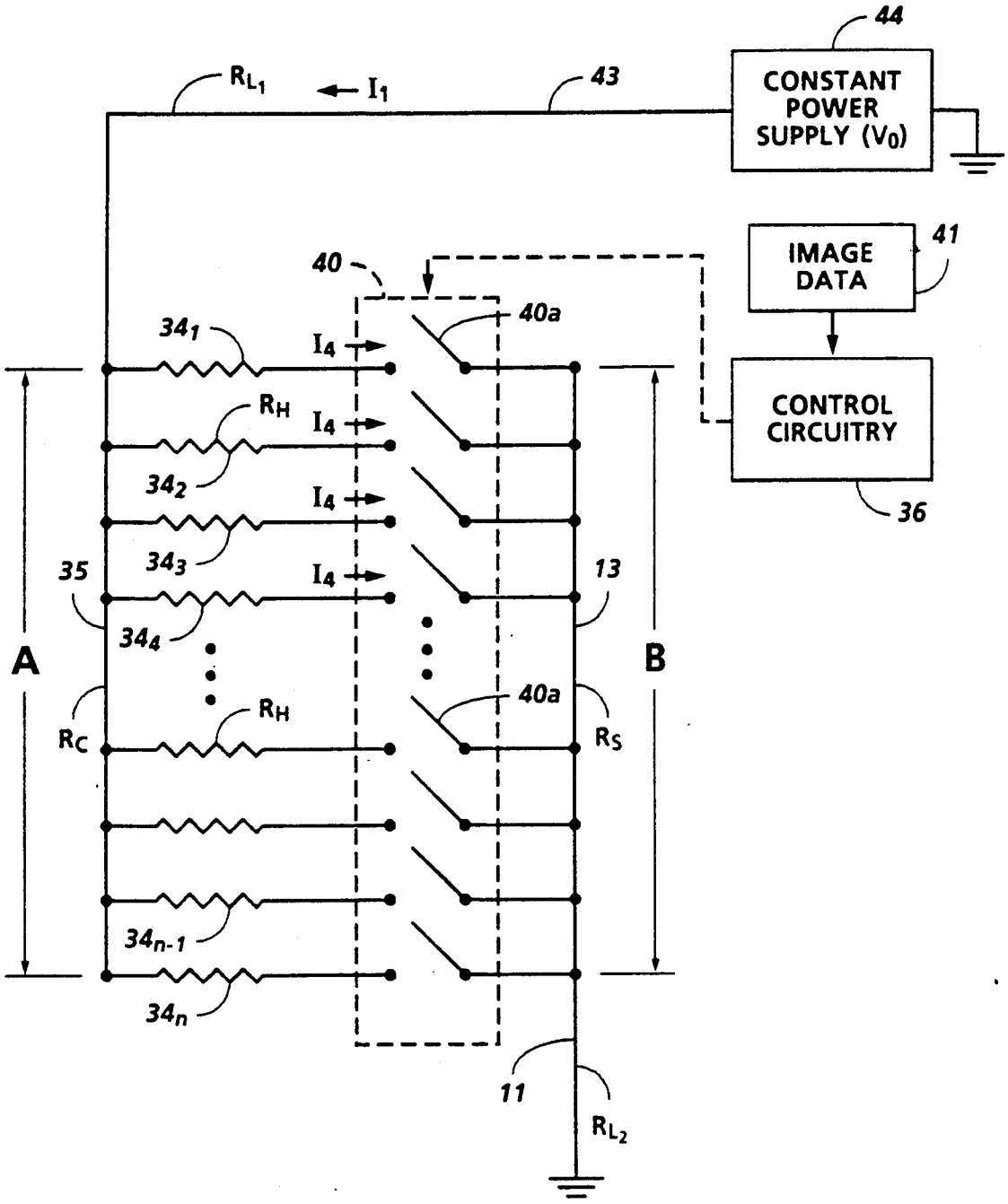
FIG. 6 is a circuit schematic demonstrating the need to vary the total energy of each pulse packet applied to the individual parallel heating elements because of increased total resistance when groups of heating elements are energized.
Figure 7:
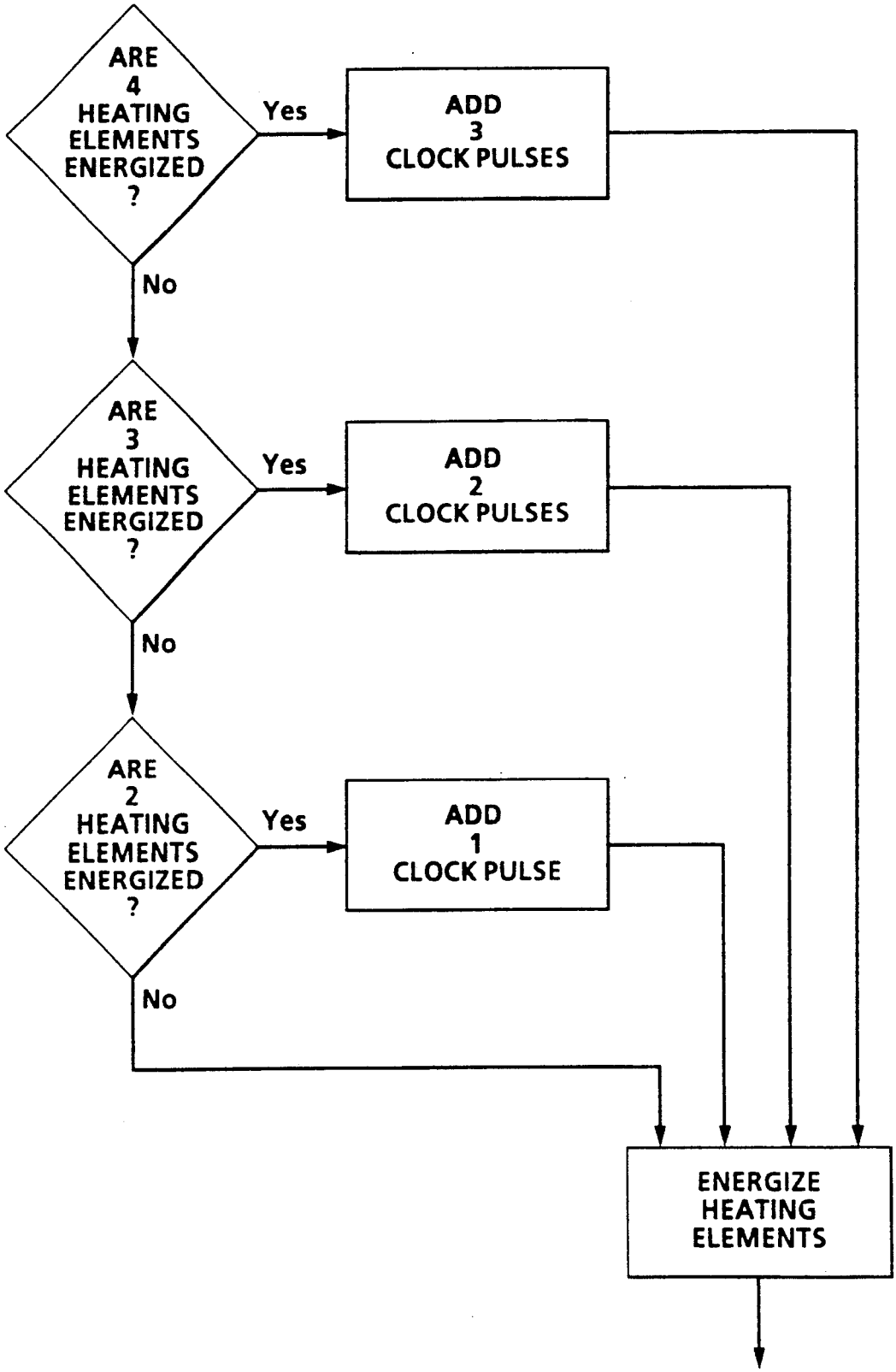
FIG. 7 is a schematic diagram of the logic used to determine the size of each pulse packet in accordance with the circuit of FIG. 7.

Referring to FIGS. 6 and 7, the heating elements are represented by resistors 34, each having resistance $R_H$ and being adapted for groups of simultaneous energization by control circuitry 36 and drivers 40, schematically represented as switches 40a within dashed line enclosure. For purposes of illustration, the resistors will be assumed to be energized in groups of four, though more or less could be used. In each group of four resistors, any one or all may be energized to expel ink droplets from the printhead nozzles. In the preferred embodiment, a constant power supply ($V_0$) 44 is used which connects to the printhead common electrode 35 via line 43, having resistance $R_{L1}$. Common electrode 35 has resistance $R_C$. The resistors are connected to ground via the drivers, sink line 13, and return cable 11. Sink line 13 has resistance $R_S$ and the cable has resistance $R_{L2}$. The distance between the first resistor $34_1$ and last resistor $34_n$ in the parallel series is shown as distance "A" in FIG. 6, while the distance between the driver of the first resistor $34_1$ and the sink line 13 and the driver of the last resistor $34_n$ along the sink line 13 is shown as distance B. It is apparent, therefore, that the current ($I_4$) through each of the four parallel resistors 34 varies depending upon whether one, two, three, or four of the resistors are simultaneously energized by current ($I_1$) from the constant voltage supply via line 43 in accordance with the input data received by the control circuitry 36.

It is also apparent that the resistance along the common return 35 and the sink line 13 both vary depending on the location of the resistor energized. For example, the resistance $R_c$ is much smaller for the first group of four resistors than the last group of four resistors in a typical array of 192 resistors (heating elements). The same is true for the resistance $R_S$ of the sink line 13. $R_L$, and $R_{L2}$ remain constant, of course. Accordingly, the location of the energized heating element determines the amount of resistance $R_C$ and $R_S$ that will effect the current $I_4$ flowing through resistor 34.

Since the common return 35 is positioned between the printhead face 29 containing nozzles 27 and the array of resistors 34, the width of the common electrode 35 is fixed. Therefore, it is the electrical downstream side of the printhead circuitry where latitude in electrode widths are available. Thus, the sink line resistance $R_S$ is very much lower than the common electrode resistance $R_C$.

Figure 8:
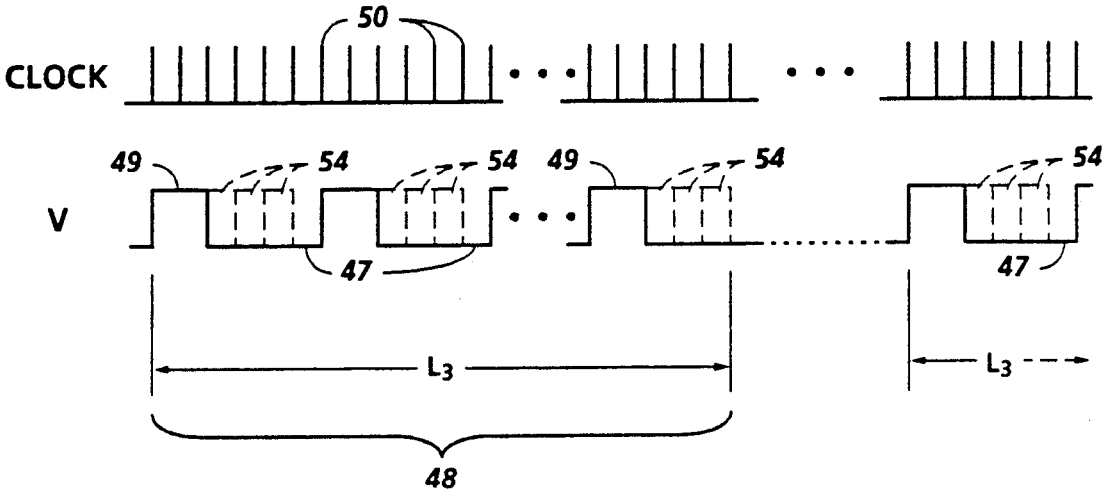
FIGS. 8 and 9 show the pulse width per pulse in each packet of pulses varied in accordance with the number of heating elements concurrently energized and/or in accordance with the relative locations of the heating elements in the printhead.
Figure 9:
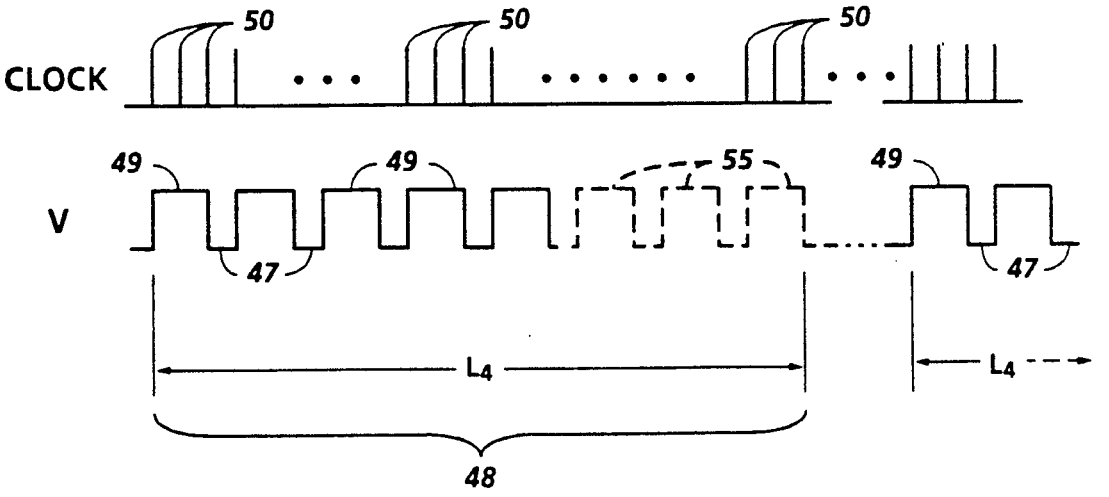

To maintain the appropriate effective power ($P_{eff}$) on each heating element when they are addressed in groups of four, for example, the number of pulses 49 per packet are increased by extra pulses 55 or the pulses 49 are increased in width by clock pulse widths 54, as shown in FIGS. 8 and 9, according to the look-up table in the controller. If all four heating elements in a particular group are simultaneously energized, the current ($I_4$) across each heating element drops, and the effective power is maintained at a sufficient level to vaporize instantaneously the ink in contact with the surface of the heating elements by the technique of either increasing the number of pulses per packet or increasing the widths of each pulse in the packet that is applied to the heating element. Accordingly, the flow chart in FIG. 7 shows that, when all four of each group of adjacent heating elements are energized simultaneously, a predetermined number of pulses per packet or pulse widths per pulse in each packet are added. For illustration purpose, for example, three clock pulse widths 54 (shown in dashed line) are added to each pulse 49 in packet 48, shown in FIG. 8, while three extra pulses 55 (shown in dashed line) are added to each packet in FIG. 9. If less than four of the heating elements in each group are energized, then less numbers of pulse widths 54 or less numbers of additional pulses 55 per packet is needed to maintain droplet volume control. If only three of the four heating elements are energized, then only two extra clock pulse widths or two extra pulses per packet are added, and if only two of the four heating elements are energized, only one extra pulse width or pulse per packet is added. Of course, if only one of the group of four heating elements is energized, then no additonal pulse width or pulses are necessary for the current $I_1$ through the line 43 to the resistors is equal to the current $I_4$ through the one resistor 34.

In an ananlogous manner to the problem of drop in effective powder produced by the heating elements when varying numbers of heating elements in each group of four are energized, the pulse packed is similarly adjusted to take into account the location of each energized heating element to compensate for the change in resistance $R_C$ and $R_S$, depending upon where along the length A of the common electrode 35 and along the length B of the sink line 13 that the energized heating element is connected. Therefore, each heating element will have its energizing packet of pulses preadjusted according to its location by information is stored into the look-up table of the controller 46.

For batch to batch manufacturing tolerance variations in the heating elements, which would produce slightly different resistance values for the heating elements, a similar technique is used to calibrate the heating elements, so that substantially uniform heating power is provided for each set of heating elements to assure droplet volume control. This is especially important when the heating elements are of the doped polysilicon type, where uniform doping is difficult to maintain. Thus, each set of heating elements may be checked for resistance values and the control circuit adapted to increase the pulse widths of the pulses in each packet or the number of pulses per packet.

As shown in FIG. 2, the control circuitry 36 for selectively applying electrical energy signals to the heating elements for energization thereof in response to the input data signals representing digitized image information includes a controller or microprocessor 46 with a look-up table 51 and clock 42. The controller is connected to each driver 40 in the array of drivers. The voltage supply 44 is connected via line 43 to the common electrode 35 of the heating elements and to ground via the drivers 40, return or sink line 13, and cable 11. Thus, the drivers essentially function as switches individually controlled by the controller 46 to enable the passage of current through the heating elements. In the preferred embodiment, the heating elements are connected in parallel and grouped in predetermined numbers for simultaneous energization of the total group or selected energization on any one of the group. Packets of pulses are used to energize each heating element for the production of one bubble of vaporized ink to expell a droplet. The quantity of effective power applied to the heating elements is adjusted by the controller by adjusting the number of pulses per packet or the pulse width of each pulse and/or pulse spacing in the packet. The pulse width and pulse spacing (idle time) are determined in whole clock units 50 produced by the clock 42. In the preferred embodiment, the power supply provides a constant voltage and the individual pulses making up the packets are constantly equal in amplitude, with the number of pulses or the pulse widths adjusted in accordance with the empirically generated look-up table 51.

The pulse widths and number of pulses per packet are determined and stored in the look-up table means well known in the controller industry.

Therefore, each packet of pulses selectively applied to the heating elements provide the appropriate burst of effective power to cause the addressed heating element to vaporize instantaneously the ink in contact with it. The momentary bubble of vaporized ink ejects an ink droplet from the printhead nozzle. The amount of effective power applied to the heating elements control the droplet volume of the ejected droplet. Appropriate values for the look-up table are empirically determined to compensate for manufacturing variations in parameters of the heating elements, such as, for example, the doping of the polysilicon material used, and for automatically compensating for the current drop across the groups of adjacent heating elements when more than one heating element in the group is simultaneously energized as explained before. The location of the heating element within the heating element array is also automatically compensated for current drop caused by different values of the resistance in the common electrode 35 and sink line 13 in view of the different lengths used thereof in electrical paths. Thus, by adjusting the effective power of the packet of pulses the droplet volume is controlled. Since temperature of the ink-heating element interface is another well known factor that impacts the ejected droplet volume, a temperature sensor 30 is used to provide a signal representative of the operating printhead temperature. The look-up table is provided with data that is used by the controller to vary the number of pulses, idle time between pulses, or the width of the pulses making up each packet of pulses applied to the heating elements in order to maintain the desired average power delivered, so that the droplet volume is controlled.

Figure 4:
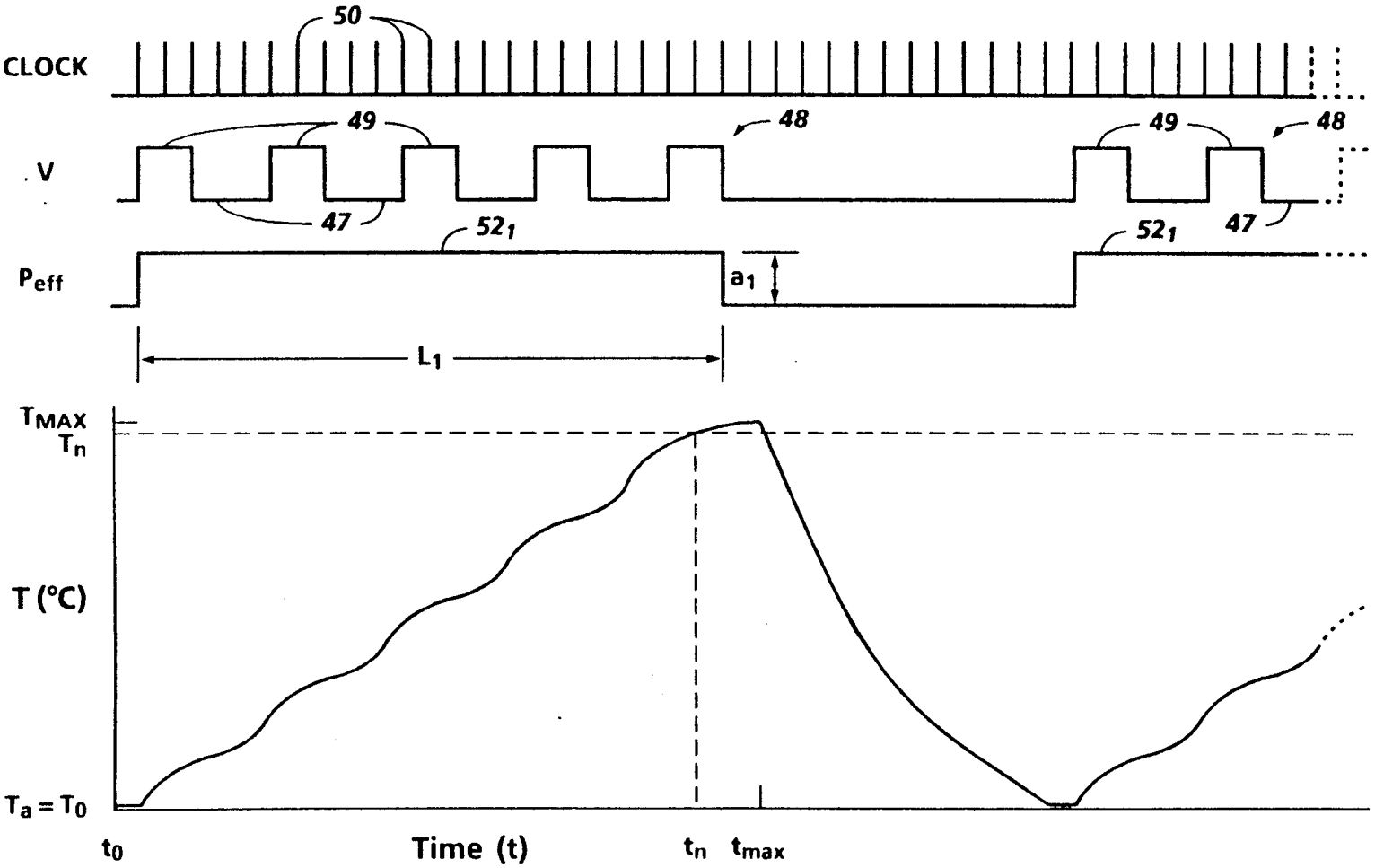
Figure 5:
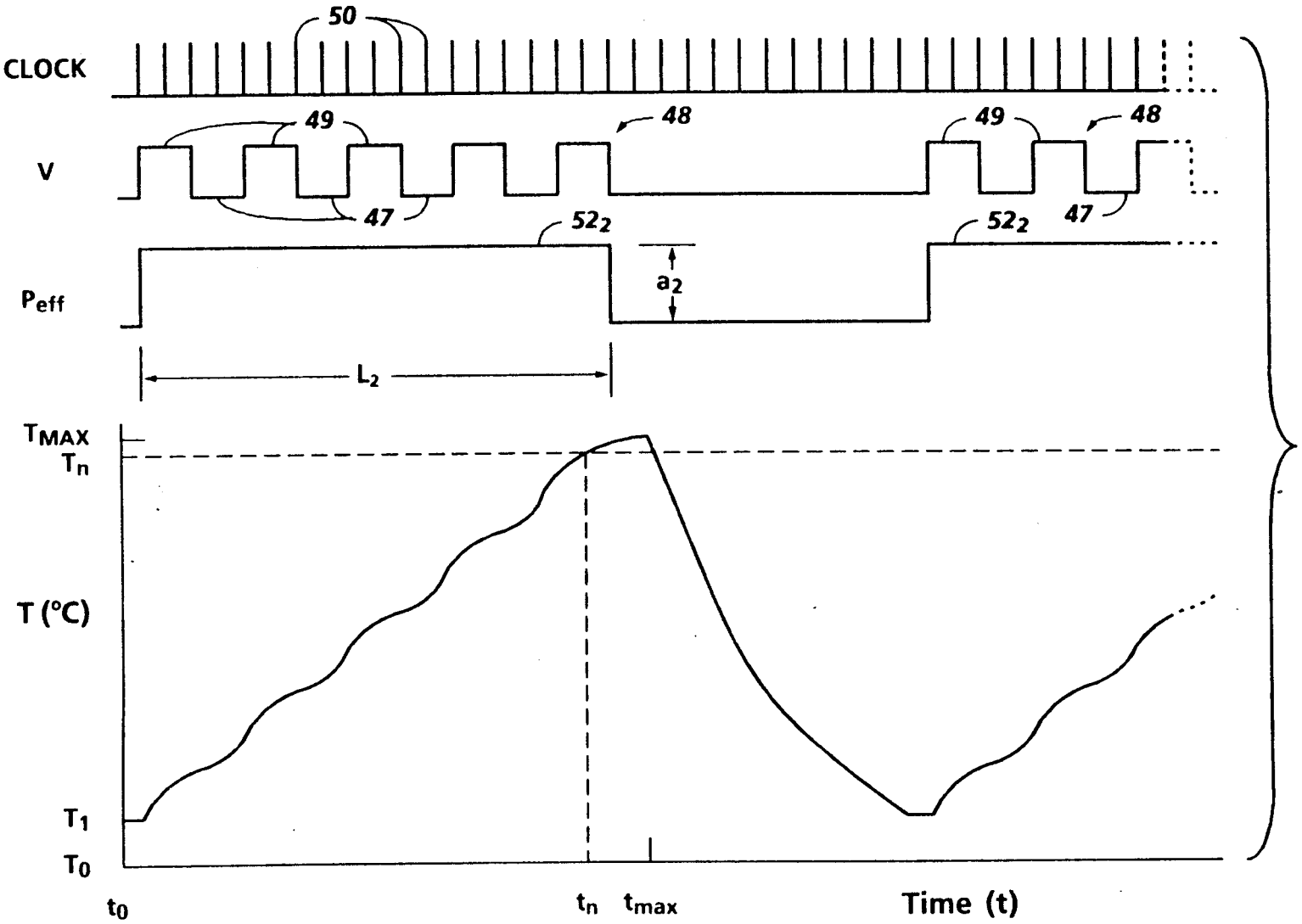

In one embodiment of this invention, the number of pulses 49 per packet 48 is selectively varied or the width of the pulses are selectively varied depending upon the sensed temperature of the printhead. Referring to FIG. 1, a temperature sensor 30 is used to provide a signal indicative of the printhead temperature in the vicinity of the heating elements 34 via line or electrode 37 to the controller 46. FIG. 4 illustrates the wave forms when the operating temperature T of the printhead is substantially equal to that of the ambient temperature $T_a$. The pulse packet 48 consists of five pulses 49 from a constant power source having a pulse width of two clock or timing units 50 and a spacing or idle time of three clock units. The temperature plot shows that the pulse packet was applied to the heating element at time $t_o$ and the temperature of the ink at the interface between the heating element surface and the contacting ink rises with each pulse in the packet 48. The nucleation temperature $T_n$ of about 280° C. is reached during the last pulse of the packet at time $t_n$ and reaches a maximum temperature $T_{max}$ shortly after the conclusion of the fifth and last pulse at time $t_{max}$. The temperature immediately falls to about its original temperature $T_o$, prior to application of another droplet emtting pulse packet to the heating element. The effecting power $P_{eff}$ is a flat rectangular waveform having an amplitude $a_1$ and the same length $L_1$ as the pulse packet. FIG. 5 illustrates the waveforms when the initial temperature ($T_1$) of the printhead is higher than the ambient temperature $T_a$, so that, at time $t_o$, the temperature of the ink at the heating element interface is $T_1$ instead of $T_o$. This means slightly less energy or effective power is required to heat the ink to the nucleation temperature $T_n$. In this case, pulse widths of the five pulse packets 48 remain the same, but the idle or off time spacing 47 between pulses 49 is equal to two clock units instead of the three clock unit spacing in FIG. 4. This provides an effective power waveform having a rectangular shape with an amplitude or height of $a_2$ which is larger than the effective power waveform amplitude $a_1$ in FIG. 4. Thus, the same number of similar size pulses per packet is applied over a smaller number of clock units, as depicted by $L_2$ in FIG. 5, than the number of clock units per pulse packet in FIG. 4, depicted as $L_1$. Accordingly, the temperature waveform or plot shows that the nucleation temperature $T_n$ is reached in a shorter time. The same temperature compensating effect could be achieved by varying the pulse width or by a combination of varying both the pulse width and the off time between pulses (neither shown).

The selection of the number of pulses per packet and their pulse widths and idle or off time spacing between pulses are selected from a look-up or history table developed empirically, so that the temperature of the printhead may be sensed by the temperature sensor 30 and the desired droplet volume is maintained, event with printhead temperature changes, by the controller in accordance with the information from the look-up table. Thus, the controller selects the desired pulse packet and resultant effective power curve for droplet volume control, which results in high quality printed images.

In summary, the electrical signals applied to the heating elements for generating droplet ejecting bubbles are composed of packets of electrical pulses. In the preferred embodiment, a constant power supply is used, providing constant amplitude electrical pulses. Each pulse in the packet and the off or idle time spacing therebetween are varied in accordance with several factors. These factors include manufacturing tolerance variations, such as encountered with polysilcon heating elements, the number of concurrently energized parallel heating elements in simultaneously addressed predetermined groups, the location of the energized heating element within the heating element array, and the temperature of the printhead in the vicinity of the heating elements. Each pulse and spacing therebetween in the packet has a width equal to one or more clock or timing units generated by the control circuitry timing device. A look-up table provides data which the controller uses to vary the number of pulses per packet or the pulse width of the pulses making up the packet to compensate for these factors, so that the volume of the ejected droplet is controlled.

Many modifications and variations are apparent from the foregoing description of this invention, and all such modifications and variations are intended to be within the scope of the present invention.

I claim:

1. A thermal ink jet printhead for ejecting and propelling ink droplets therefrom to a recording medium on demand in response to digitized image data signals, the printhead having means to control the volume of the ejected droplet, comprising:

a structure having an ink supplying reservoir, plurality of nozzles, and ink flow directing channels providing communication between the nozzles and reservoir;

means for providing ink to the reservoir;

a plurality of selectively addressable heating elements within the channels, one for each nozzle, the heating elements being adapted to produce momentary ink vapor bubbles when energized, said bubbles ejecting ink droplets from the nozzles;

a power supply; and a control circuit for selectively applying electrical energy signals to the heating elements for energization thereof in response to said data signals, the control circuit including a timing device, a controller with a look-up table and drivers and being adapted to apply said energy signals in the form of packets of electrical pulses, each packet of pulses providing a sufficient burst of effective power to cause the addressed heating element to vaporize instantaneously the ink contact therewith to produce a momentary bubble that ejects an ink droplet from the printhead nozzle, each pulse width and idle time between pulses in each packet of pulses are predetermined whole numbers of clocking units generated by said timing device, wherein the look-up table provides data to the controller for generating pulse packets on a per nozzle basis for overcoming manufacturing tolerance variations, the location of the addressed heating element, and for taking into account the reduction in current from said power supply when the number of simultaneously addressed heating elements vary.

2. The printhead of claim 1, wherein each pulse width and idle time between pulses in each packet of pulses are selectively varied by whole numbers of clocking units generated by said timing device, wherein the controller look-up table identifies the variation in the number, pulse width, or spacing therebetween for the pulses per packet on a per nozzle basis.

3. The printhead of claim 2, wherein the printhead further comprises:

means for sensing the temperature of the structure in the vicinity of the heating elements; and in response to the temperature of the structure, means for adjusting either the number of pulses per packet, each pulse width, or width of idle time between pulses to compensate for the temperature and to control the temperature sensitive volume of the ejected ink droplet.

4. The printhead of claim 3, wherein the power supply is constant, so that the pulses in each packet have a constant amplitude.

5. A method of controlling the volume of an ejected ink droplet from a thermal ink jet printhead having an ink reservoir, plurality of nozzles, and ink flow directing channels providing communication between the nozzles and reservoir, each nozzle having an associated, selectively addressable heating element adapted to produce momentary ink vapor bubbles, when the heating elements are addressed with electrical energy representative of digitized data signals, thereby ejecting an ink droplet from the nozzles, the method comprising:

energizing the heating elements with packets of individual electrical energy pulses instead of single pulses, each packet of pulses representing a unit of digitized data requiring the explosion of an ink droplet, each packet of pulses being sufficient in number to cause the addressed heating element to vaporize instantaneously the ink contacting the heating element;

providing clocking signals having predetermined units per time period;

controlling the number of pulses per packet, based upon a look-up table, with each pulse width and width of spacing between pulses being variable multiple, whole units of clock signals, said look-up table being established to take into account manufacturing tolerance variation, location of the energized heating element within the printhead, and the varying number of heating elements concurrently energized for simultaneous ejection of plural ink droplets, so that the desired droplet volume is maintained.

6. The method of claim 5, wherein the method further comprises:

sensing the temperature of the printhead in the vicinity of the heating elements and generating a temperature signal indicative of the temperature sensed; and optimizing each packet of pulses in accordance with the temperature to control the volume of the ejected ink droplet.

* * * * *